US009945230B2

(12) United States Patent
Lim

(10) Patent No.: US 9,945,230 B2
(45) Date of Patent: Apr. 17, 2018

(54) SILENT GEAR PUMP OR MOTOR SUPPRESSING TROUBLES OF TRAPPING FLUID

(71) Applicant: Nag-Bok Lim, Kwangmyung (KR)

(72) Inventor: Nag-Bok Lim, Kwangmyung (KR)

( * ) Notice: Subject to any disclaimer, the term of this patent is extended or adjusted under 35 U.S.C. 154(b) by 234 days.

(21) Appl. No.: 14/785,303

(22) PCT Filed: Apr. 16, 2014

(86) PCT No.: PCT/KR2014/003320

§ 371 (c)(1),
(2) Date: Oct. 16, 2015

(87) PCT Pub. No.: WO2014/171744

PCT Pub. Date: Oct. 23, 2014

(65) Prior Publication Data

US 2016/0108733 A1 Apr. 21, 2016

(30) Foreign Application Priority Data

Apr. 17, 2013 (WO) ..... PCT/KR2013/003226

(51) Int. Cl.
*F01C 21/00* (2006.01)
*F04C 18/08* (2006.01)
(Continued)

(52) U.S. Cl.
CPC ..... *F01C 21/006* (2013.01); *F01C 1/088* (2013.01); *F01C 1/18* (2013.01); *F01C 21/108* (2013.01);
(Continued)

(58) Field of Classification Search
CPC ..... F01C 1/088; F01C 21/006; F04C 18/088; F04C 2270/135; F04C 29/0035
See application file for complete search history.

(56) References Cited

U.S. PATENT DOCUMENTS 4,097,206 A 6/1978 Schonherr
6,042,352 A 3/2000 Halter et al.
6,123,533 A 9/2000 McBurnett et al.

FOREIGN PATENT DOCUMENTS

CN 1192510 9/1998
CN 2789462 6/2006
(Continued)

OTHER PUBLICATIONS

English abstract of JP-2003-083263; Mar. 19, 2003.
(Continued)

*Primary Examiner* — Mary A Davis
(74) *Attorney, Agent, or Firm* — Antonio Ha & U.S. Patent, LLC

(57) ABSTRACT

Fluid delivery devices using a pair of meshed external gears, in spite of no reciprocating component for fluid delivery enabling low rotational vibration, the high noise due to the trapping phenomenon, and the teeth bouncing contact due to undesired large backlash heretofore afforded in the gear manufacturing process, restrict the employments in the industrial field requiring quiet environment such as electric motor vehicles or room services.
Accordingly, a gear pump or motor or a gear refrigerating compressor comprising a shaft gear and a driven gear meshed rotatably within a gear chamber formed with a housing and opposite side walls, which delivers fluids from a inlet chamber to a outlet chamber; a backlash of the meshed gears having fluid-leak-tight clearance; a closed chamber provided in a internal portion of at least a side wall; an opening provided on a side wall from which a communication passage extends to a closed chamber; and at least a elastic disc capsule contained in the closed chamber, comprising a pair of concaved elastic disc plate abutted and sealed against each other with gas inside, of which occupying volume varies elastically subject to the fluid pressure
(Continued)

therein enabling to absorb or expel the squeezed fluid in the trapped interstice during the trapping period of the interstice, whereby the fluid entrapped in the interstices isolated by the fluid-leak-tight backlash suppressing the pressure transmission inwardly or outwardly, whereof volumetric variation during the trapping period is compensated by the compression or expansion of the elastic disc capsule, suppressing pressure pulse and air bubble generation and eliminating the teeth bouncing contact, achieving a low noise, low vibration and high efficiency gear pump or motor or refrigerating compressor.

5 Claims, 5 Drawing Sheets

(51) Int. Cl.

| | |
|---|---|
| ***F04C 29/00*** | (2006.01) |
| ***F01C 1/08*** | (2006.01) |
| ***F04C 18/18*** | (2006.01) |
| ***F01C 1/18*** | (2006.01) |
| ***F01C 21/10*** | (2006.01) |

(52) U.S. Cl.
CPC ..... *F04C 18/088* (2013.01); *F04C 18/18* (2013.01); *F04C 29/0035* (2013.01); *F04C 2230/602* (2013.01); *F04C 2270/135* (2013.01)

(56) References Cited

FOREIGN PATENT DOCUMENTS

| | | | | |
|---|---|---|---|---|
| CN | 101223363 | | 7/2008 | |
| CN | 202370829 | | 8/2012 | |
| DE | 102010039262 | | 2/2012 | |
| EP | 0879962 | | 11/1998 | |
| JP | 54-149002 | | 11/1979 | |
| JP | 2002013494 A | * | 1/2002 | ..... F04C 18/088 |
| JP | 2003-083263 | | 3/2003 | |
| JP | 2006-233776 | | 9/2006 | |

OTHER PUBLICATIONS

English abstract of JP-2006-233776; Sep. 7, 2006.
English translation of CN 1192510; Sep. 9, 1998.
English translation of CN 2789462; Jun. 21, 2006.
English translation of CN 101223363; Jul. 16, 2008.
English translation of CN 202370829; Aug. 8, 2012.
English translation of JP 54-149002; Feb. 22, 2017.
English translation of DE 102010039262; Feb. 16, 2012.
English translation of EP 0879962; Feb. 22, 2017.

* cited by examiner

SILENT GEAR PUMP OR MOTOR SUPPRESSING TROUBLES OF TRAPPING FLUID

RELATED APPLICATIONS

This application claims that the benefit of the P.C.T. Application No. PCT/KR2013/003226 filed 17 Apr. 2013, which is hereby incorporated herein by reference.

FIELD OF THE INVENTION

The present invention relates generally to a fluid delivery device comprising a pair of meshed external gears. More particularly it relates to a gear pump or motor, or a gear refrigerating compressor, having a pair of external gears rotatably mounted in a gear chamber.

BACKGROUND OF THE INVENTION

Fluid delivery devices using a pair of meshed external gears, which are unique in a rotational construction using no reciprocating component for fluid delivery enabling low rotational vibration, have a high power density in a simple and economic construction so that various applications are made in the industrial fields such as pumps or motors. However, in spite of the merits as such, the high noise and aeration due to meshing external gears has restricted the employments in a quiet environment equipments such as pumps or motors or refrigerating compressors for electric motor vehicles or room services or in a large delivery volume application.

During the normal operation of a fluid delivery device in the prior art, the teeth of the meshed gears create interstices between the root curves and the mating tooth tips respectively of which volume decreases until it reaches at the theoretical plane including the centers of the support shafts of the gears and increases thereafter during the tooth contact moves along the line of action, wherein trapped fluid still create high pressure ripples during the decreasing process and aeration during increasing process, causing severe noise and cavitation, which is known as trapping phenomenon.

It is known that the troubles due to the aforesaid trapping phenomenon comes from which the incompressible fluid confined in a variable volume of a rigid interstice during the rotation of the gear's, wherein the pressure variation has inevitably mutual affection with inlet and outlet chamber by the pressure transmission or fluid leakage inwardly or outwardly through the clearances surrounding the trapped interstice, such as gear backlash and the clearances along the side face of gears, which invites pressure ups not only in the trapped interstice, but also in the high pressure chamber, creating pressure pulse in high hertz.

Thereto the aforementioned troubles due to the trapping phenomenon, the backlash of the gears in the prior art, which are established in the allowance range for affording smooth meshing operation, is heretofore large enough for transmitting the pressure between the loaded chamber and the trapped interstice, escalating the pressure rise mutually exceeding the pressure of the load chamber when the contact point of the meshed teeth is located between the decreasing trap interstice and the increasing trap interstice. Wherein the high pressure 48 as shown in FIG. 9 in a pump or a gear compressor for refrigeration, 50 as shown in FIG. 12 in a motor generated in the decreasing trap interstice pushes the flanks disposed in the trap interstice against each other so that the backlash allows the contacting flanks to be separated, generating a clearance between the contacting faces, through which the fluid in the decreasing trap region is relieved to the adjacent increasing trap interstice sequentially. Right after the relief of the high pressure therein upon the rotation of the gears, the driven gear is forced to be rotated forward by the pressure of the loaded chamber, 47 as shown in FIG. 9 in a pump or a compressor for refrigeration, and 49 as shown in FIG. 12 in a motor, so that the tooth contact with the shaft gear is made again, generating teeth bouncing contact against each meshed tooth for every trapping interstice of driven gear side with severe noise and vibration in high hertz. Sealing off the backlash is required not only for suppressing the pressure in the trapped interstice but also for preventing teeth bouncing contact.

An approach of the prior art to solve the aforesaid problems, which provides a ripple chamber in a considerable volume size, having a first passage connecting to the trap region through first passage to dampen the trapped high pressure, and a second passage to discharge the fluid into the inlet side, wherein, however, the fluid confined in a ridged vessel is hardly dampen due to the incompressibility of the fluid.

Another approach of the prior art to solve the aforesaid problems, which provide plunger reciprocating by the pressure difference between the pressure in the squeezed fluid trapped in a trap region and the one in the discharge chamber for releasing the trapped fluid into low pressure side via the communication passages therein, wherein the reciprocating movement of plunger create another pulses into the high pressure side thereby high noise still remains.

Another approach of the prior art to solve the aforesaid problems, which provide a elastic body such as foam rubber in a concave on a surface of a side plate of which one end of elastic body faces the trapped region of the gears for absorbing the squeezed fluid by the elastic body, wherein the fluid leakage from discharge chamber through a clearance between side face of gears and side walls at the moment of beginning the trapping period due to the bigger pressure difference between the discharge chamber and trapped region facing elastic body in the concave, thereby sufficient damping is disturbed and pressure pulses due to the pressure down in the high pressure chamber in a high cycle, resulting high noise.

And some approaches of the prior art to solve the aforesaid problems, which provide passages to relieve the pressure in the trap region through a passage communicating either to the inlet or outlet chamber, revealed a sudden pressure drop in the high pressure chamber and fluid leakage into trap chamber and losing volumetric efficiency, or higher pressure pulse due to direct transmission of the decreased volume in to high pressure chamber.

SUMMARY OF THE INVENTION

The object of the present invention is to provide a silent gear pump or motor, or a gear refrigerating compressor having apparatus to solve aforementioned problems.

Accordingly, the present invention provides means to compensate a variable volume of trapped interstice, sealing the trapped fluid off the high pressure chamber, and means to prevent teeth bouncing contact, comprising, a fluid-leak-tight backlash of meshing gears;

a compensating chamber provided in a middle portion of at least one of the side walls:

at least an elastic disc capsule contained in a compensating chamber having compressible gas therein, which has strength enabling to save a space for absorbing the squeezed fluid against a pressure therein for sealing off the trapped interstice during a beginning moment of the decreasing trap interstice; and a single passage extended from the compensating chamber to an opening provided on a surface portion of a side wall, whereof opening is closed by a side face of the gears but ready to be opened to the decreasing trap interstice at a starting moment of the decreasing trap interstice, and upon further rotation of gears, the opening is opened to the trapped interstice during the both period from decreasing to increasing sequentially.

Whereby, at the beginning moment of the decreasing trap interstice of the meshing gear, the trapped interstice are sealed off inwardly or outwardly by the fluid-leak-tight backlash and the closed opening of the passage, which forms a pressure buffer zone between the loaded chamber and the compensation chamber, so that the elastic disc capsule is protected from being collapsed by the pressure transmission from the high pressure chamber to the compensating chamber via the trapped interstice, and also sudden pressure drop in the loaded chamber is prevented. And upon further rotation of the gear, the decreasing trap interstice starts to communicate with the compensating chamber and the excessive volume of the trapped fluid therein is absorbed by the reduced space of the elastic disc capsules responding to the trap cycles in extremely high frequency, wherein the presetting of the operating pressure in the compensating chamber against the strength of the deflection of the elastic disc capsule is possible so that high pressure ripple therein and the disengagement of the teeth are prevented, eliminating teeth bouncing contact. And upon further rotation of the gears, the volume of the trapped interstice becomes its minimum at the theoretical plane including the centers of the support shafts of the gears, thereafter the volume of the trapped interstice increase creating a vacuum pressure wherein the increased space is filled up with the fluid repelled from the compensating chamber through the communication passage by the pressure difference between the elastic disc capsule and the increasing trap interstice, suppressing air bubble generation. Whereby the variation of the volume trapped in the interstice of meshed gears is compensated by the elastic disc capsule without undesirable loss of high pressure fluid in the discharge chamber, which is enable to suppress pressure pulse, cavitation, teeth bouncing contact, achieving low noise, low vibration and high efficiency gear pump or motor or gear refrigerating compressor.

BRIEF DESCRIPTION OF DRAWINGS

The novel feature of this invention itself, both as to its construction and its method of operation, together with objects and advantages thereof, will become apparent from the following detailed description of specific embodiments when considered in conjunction with the accompanying drawings, wherein.

DESCRIPTION OF THE PREFERRED EMBODIMENTS

Figure 1:
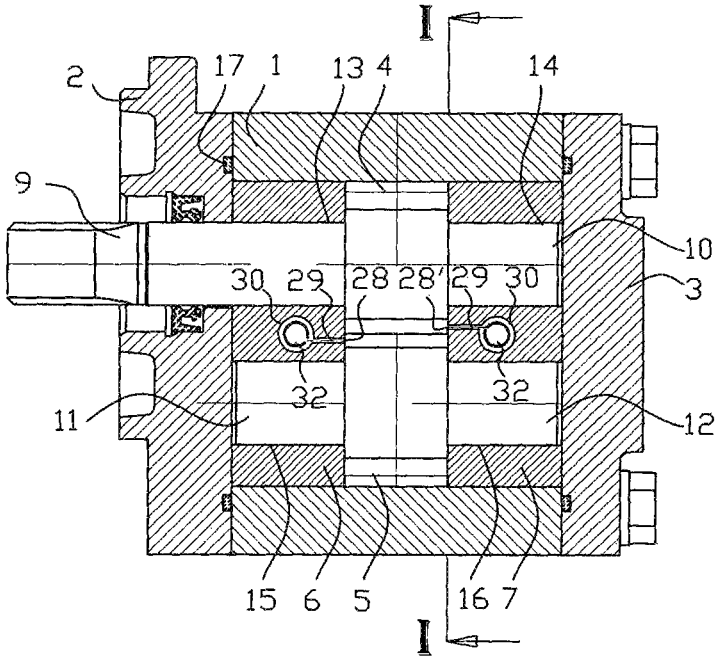
FIG. 1 is a sectional view of a gear pump or a motor or a gear refrigerating compressor with bearing blocks showing plural elastic capsule contained in a compensating chamber with a communicating passage according to the present invention.
Figure 2:
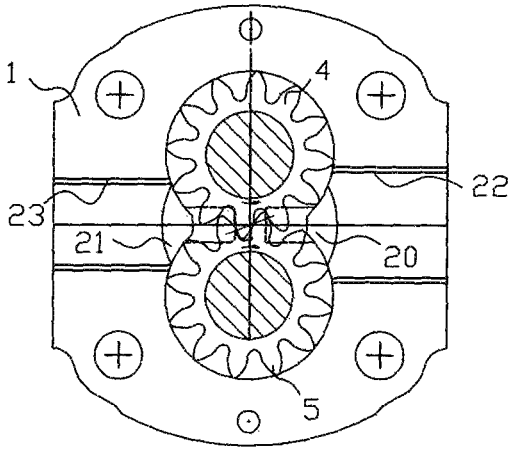
FIG. 2 is an enlarged cross-sectional view of a pump or motor or a gear refrigerating compressor taken along the line I-I of FIG. according to the present invention.
Figure 3:
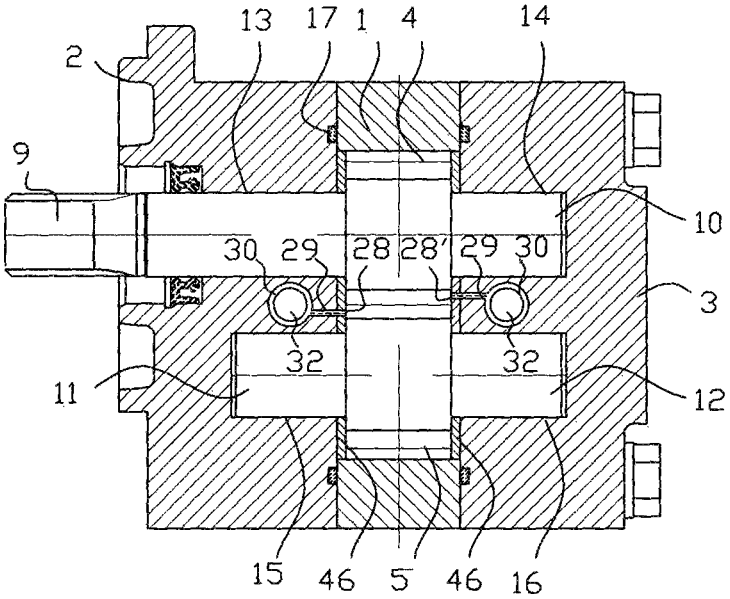
FIG. 3 is a sectional view of a gear pump or motor or a gear refrigerating compressor with wearing plates showing plural elastic capsule contained in a compensating chamber with a communicating passage according to the present invention.

Referring now to the drawings in detail and initially to FIGS. 1 and 2, there is shown one embodiment of a gear pump or motor, or a gear refrigerating compressor, according to the present invention. Therein a central housing 1 provides two intersecting bores for a gear chamber, having a cross section substantially in the form of a peanut. The gear chamber contains a pair of meshed external gears 4 and 5 having supporting shaft 9, 10, 11 and 12, of which ends are closed by opposite bearing blocks 6 and 7. The housing end plates 2 and 3 are fixed thereto by screws as illustrated in the embodiment. The shafts 9, 10, 11 and 12 of the gears are mounted in rotatable way at bearing bores 13, 14, 15 and 16 in the bearing blocks 6 and 7. The shaft 9 extends through the bearing block 6 to the outside of the end plate 2, for jointing with a prime mover (not illustrated) to rotate the gear 4 serving as a shaft gear and the gear 5 serving as a driven gear.

The fluid-leak-tight backlash 8 of the meshed gears 4 and 5 is provided in a small clearance by a precision manufacturing means such as tooth face grinding process to correct an undesirable deformation due to a heat treatment, which allows that the trailing flank disposed in the trap region may slide over the mating flank enabling to seal off the trap region. Plural seals 17 are provided between the central housing 1 and the end plates 2 and 3. An inlet chamber 20 and an outlet chamber 21 are formed on opposite sides of the meshed teeth of the gears when the rotational directions of the gears are indicated as the arrows shown in the FIG. 9-FIG. 1 for a pump or compressor and FIG. 12-FIG. 14 for a motor. The chambers 20 and 21 are connected respectively to the ports 22 and 23 which are provided for connections to hydraulic parts.

Figure 4:
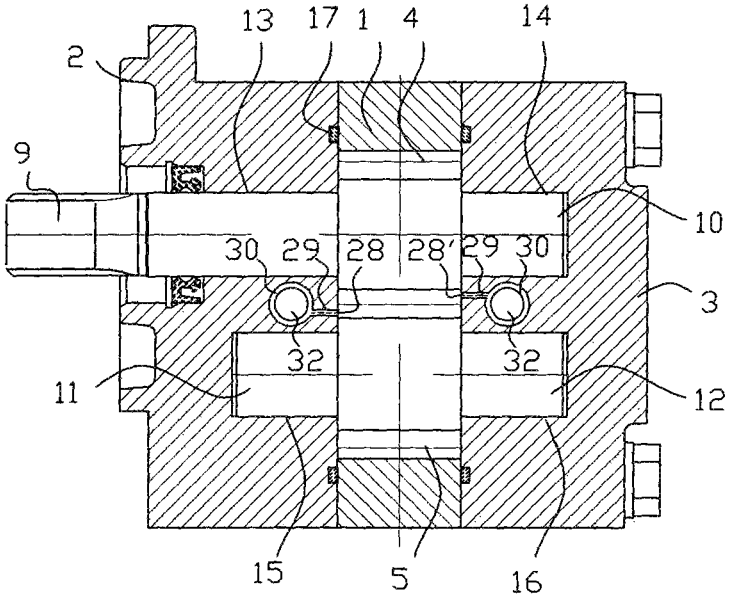
FIG. 4 is a sectional view of a gear pump or motor or a gear refrigerating compressor with side walls of the end plates showing plural elastic capsule contained in a compensating chamber with a communicating passage according to the present invention.
Figure 5:
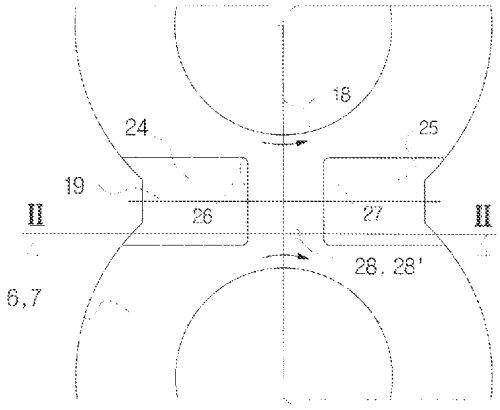
FIG. 5 is an enlarged partial view of a side wall or bearing block according to the present invention showing a opening of a passage which connects to compensating chamber (not shown) according to the present invention.
Figure 6:
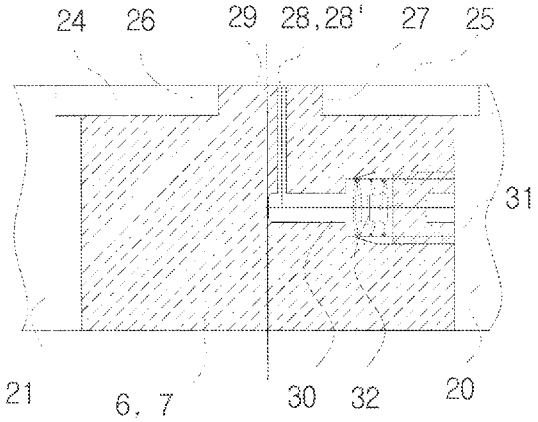
FIG. 6 is a cross-sectional view of a side wall or a bearing block taken along the line II-II of FIG. 5 showing plural elastic disc capsule contained in a compensating chamber with a communicating passage according to the present invention.
Figure 7:
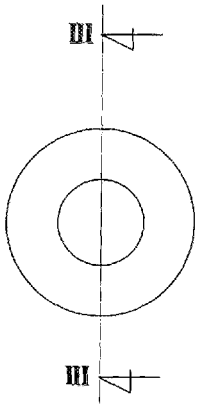
FIG. 7 is a top view of an elastic disc capsule according to the present invention.
Figure 8:
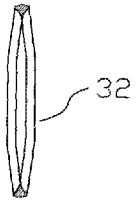
FIG. 8 is a sectional view of an elastic capsule taken along the line III-III of FIG. 6 according to the present invention.
Figure 12:
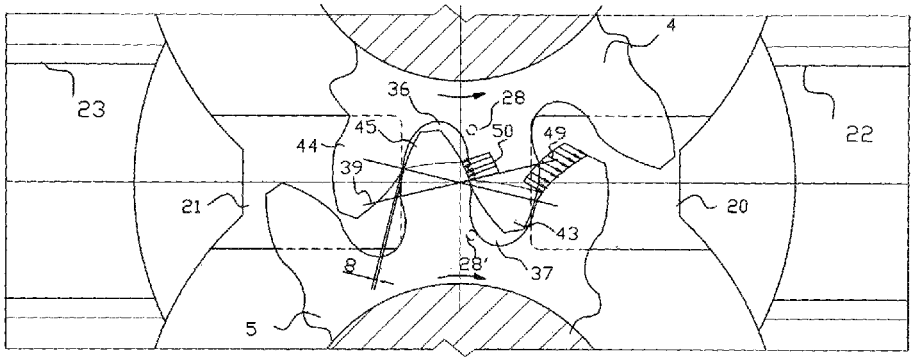
FIG. 12 is an enlarged partial cross-sectional view with a side wall of a motor taken along the line I-I of FIG. 1 showing an opening of the passage is closed but ready to be opened by the side faces of the said gears at the very moment of starting to trap a decreasing interstice and pressure distribution on a driven gear disclosed therein, forming one teeth contact point along the line of work between the decreasing interstice and the increasing interstice, according to the present invention.

As shown in FIG. 5-6, so called the relief grooves 24, 25 having the limit lines 26, 27 are formed on the side walls or on the bearing blocks 6, 7 establishing the trapped volume of the decreasing or increasing trap region in a minimum size. A blind bore 30 plugged as shown in FIG. 4, functioning as a compensating chamber, is provided at a middle portion on each of the bearing block 6, 7, from which a passage 29 extends to a opening 28 on a side walls. Wherein the opening 28 is located at a place being closed but ready to be opened by the side face of the tooth 40, 43 at the very moment that the decreasing interstice 33, 36 starts to trap the fluid therein, as shown in FIG. 9, FIG. 12, and upon further rotation of gears thereafter, the opening 28 is also located at a place communicating with the compensating chamber 30 to a trapped interstice 33, 36 during the rest period of decreasing or increasing sequentially.

A plural quantity of the elastic disc capsule 32 is provided independently in the compensating chamber and each of the elastic disc capsule 32 comprises a pair of concaved elastic discs forming an internal space containing compressible air or gas sealed therein, of which surfaces yield elastic deformation to the presetting pressure of the trapped interstice, whereby the summation of the each elastic disc capsule deformation absorbs the reduced volume of the trapped fluid in the decreasing interstice without sudden pressure drop in the high pressure chamber, or repels the fluid of the compensating chamber into the increasing interstice in a fast response to the pressure variation of the compensating chamber in extremely high frequency.

Hereinafter a description about an operation of a preferred embodiment of a pump or a gear refrigerating compressor of which operation is similar with a pump, and a motor according to the present invention will be made.

Figure 9:
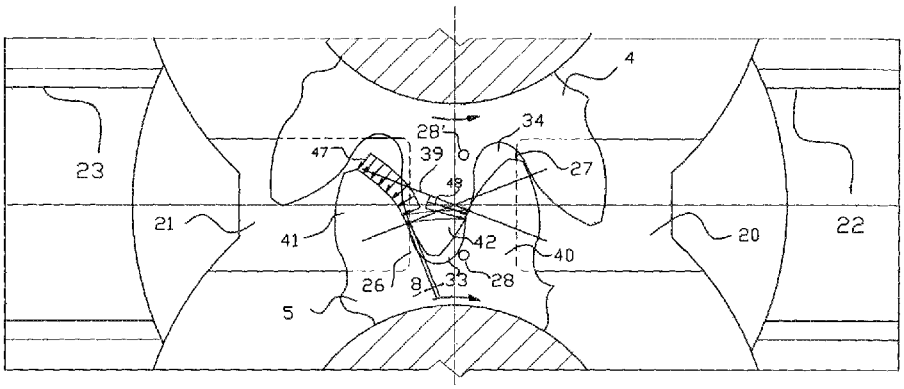
FIG. 9 is an enlarged partial cross-sectional view with a side wall of a pump or a gear refrigerating compressor taken along the line I-I of FIG. 1 showing an opening of the passage is closed but ready to be opened by the side faces of the said gears at the very moment of starting to trap a decreasing interstice and pressure distribution on a driven gear disclosed therein, forming one teeth contact point along the line of action between the decreasing interstice and the increasing interstice, according to the present invention.

When the shaft 9 of a pump or a gear refrigerating compressor is rotated by a prime mover, the meshed gears 4 and 5 of the pump or a gear refrigerating compressor rotate in the direction indicated by the arrows as shown in FIG. 9, so that the fluid introduced into the inlet chamber 20 via the inlet port 22 is delivered to the outlet chamber 21 by moving the fluid confined in the inter-teeth spaces of the gears respectively. But for a motor, the shaft 9 of a motor is rotated by the pressurized fluid which are supplied into the inlet chamber 20 via the inlet port 22, and the meshed gears 4 and 5 of the motor are rotated in the direction indicated by the arrows as shown in FIG. 12, delivering the fluid confined in the inter-teeth spaces of the gears respectively to the outlet chamber 21. The inlet and outlet chambers are separated by the meshed teeth. When the gears are meshing through along the line of action 39, interstices are generated between the root curves and the tips of the shaft and driven gears respectively, thereof volume decrease until they reach the theoretical plane 18 including the centers of the gear shafts, and increase thereafter, as such the interstice 33 or 35 of a pump or a gear refrigerating compressor as shown in FIG. 9-FIG. 11 and the interstice 36 or 38 of a motor, as shown in FIG. 12-FIG. 14.

In the case that the only one teeth contact point is made along the line of action between the decreasing interstice and the increasing interstice, at the starting moment that the decreasing interstice 33,36 has been trapped just beyond the limit line 26 of the relief groove 24, as shown in FIG. 9 or FIG. 12, the fluid-leak-tight back lash according to present invention, cut off the pressure transmission between the trapped interstice 33, 36 and the outlet chamber 21, and an opening 28 is covered by the side face of the tooth 40, 43 but ready to be opened upon further rotation of the gear, forming a pressure buffer zone between the outlet chamber 21 and the compensation chamber 30. Thereby the trapped fluid becomes to be isolated temporarily during the transition period of starting to trapping the interstice suppressing the pressure transmission inwardly, and the pressure balance between the trapped interstice 33, 36 and the compensating chamber 30 is maintained by the stiffness of the elastic disc capsule 32 enabling to prevents a sudden pressure drop in the outlet chamber.

Figure 10:
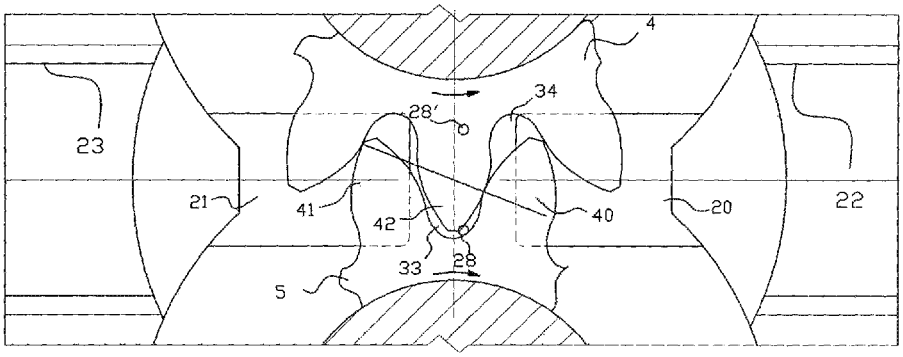
FIG. 10 is an enlarged partial cross-sectional view with a side wall of a pump or a gear refrigerating compressor taken along the line I-I of FIG. 1 showing an opening of the passage and the trap interstice in relatively positions at the moment of ending the decreasing trap and also ready to start the increasing trap, according to the present invention.
Figure 11:
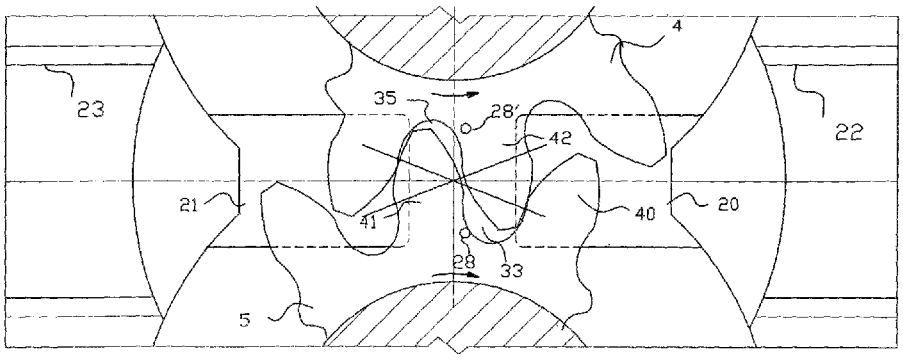
FIG. 11 is an enlarged partial cross-sectional view with a side wall of a pump or a gear refrigerating compressor taken along the line I-I of FIG. 1 showing an opening of the passage and the trap interstice in relatively positions at the moment of ending the increasing trap and also of starting the next decreasing trap interstice forming two teeth contact points according to the present invention.
Figure 13:
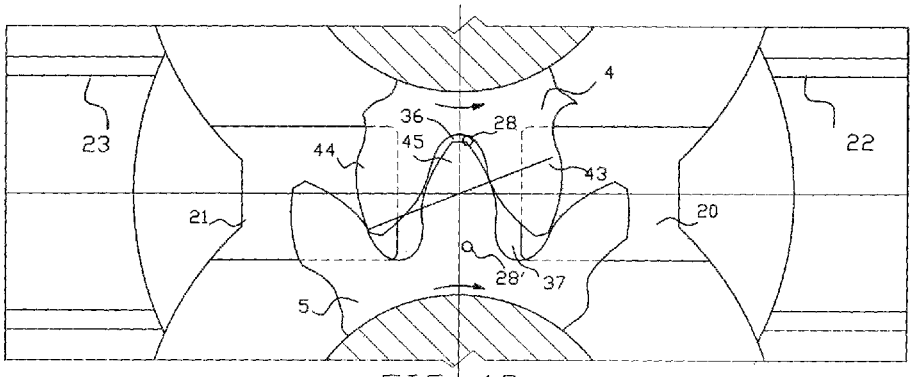
FIG. 13 is an enlarged partial cross-sectional view with a side wall of a motor taken along the line I-I of FIG. 1 showing an opening of the passage and the trap interstice in relatively positions at the moment of ending the decreasing trap and also ready to start the increasing trap, according to the present invention.
Figure 14:
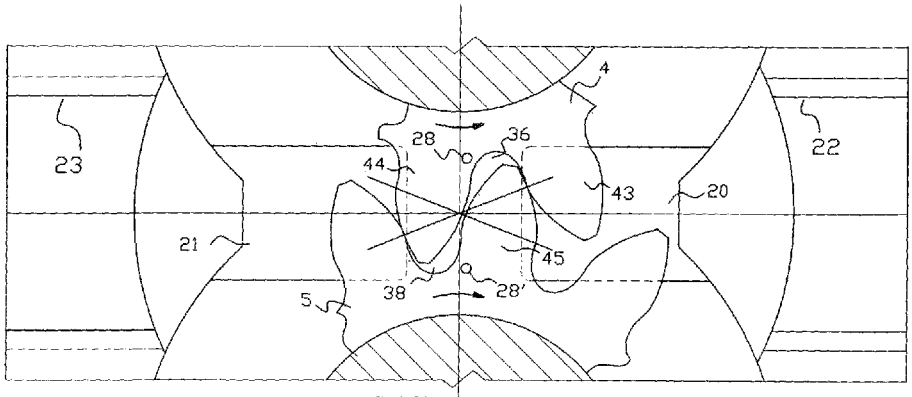
FIG. 14 is an enlarged partial cross-sectional view with a side wall of a motor taken along the line I-I of FIG. 1 showing an opening of the passage and the trap interstice in relatively positions at the moment of ending the increasing trap and also of starting the next decreasing trap interstice forming two teeth contact points, according to the present invention.

By further rotation of the gears as shown in FIG. 10, FIG. 13, the sealing land along the periphery of the trapped interstice33, 36 grows thicker for sealing out the outlet chamber 21, and the opening 28 comes to be opened progressively to the trap interstice 33, 36. Thus the decreased fluid volume therein is delivered through the passage 29 to the compensating chamber 30 to be absorbed by the elastic disc capsule 32 without exceeding a preset pressure controlled by selecting the stiffness of the elastic disc capsule, suppressing occurrence of the pressure ripple in the trapped interstice and the gear teeth bouncing contact.

When the geographic center of the trapped interstice 33, 36 approaches the theoretical plane 18 including the centers of the support shafts of the gears, of which volume reaches its minimum volume and starts to be increased thereafter as shown in FIG. 10, FIG. 13 creating sudden pressure drop therein. The pressure difference between the elastic disc capsule 32 and the increasing interstice 33, 36 expels the fluid of the compensating chamber 30 into the increasing interstice through the passage 29 and the opening 28 which is opened during the period to fill up the increased volume in the interstice, which prevents the vacuum pressure causing the air bubble creation is suppressed and also allows that the elastic disc capsule recovers the space for being ready to be compressed at next cycle. Upon further rotation of the gears, the increasing interstice 33, 36 starts to communicate with the inlet chamber and the opening 28 comes to be closed by the gear 41, 44 as shown in FIG. 11, FIG. 14. At the same time, a following interstice 35, 38 on the root of the mating gear starts to be trapped, which forms a pair of interstice with two contact point along the line of action having the backlash between the decreasing interstice 35, 38 and the increasing interstice 33, 36, commencing a new cycle of trapping interstice in the relation with the opening 28' on the opposite side wall at a location of symmetric apposite with the centerline 19 to the location of the opening 28. Whereby troubles created by the trapping phenomenon such as pressure pulse and air bubble creation, and teeth bouncing contact are suppressed, achieving a low noise, high efficiency gear pump or motor or refrigerating compressor.

It will be understood that each of the elements described above, or two or more together, may also be found as a useful application in other types of gear pumps or motors or a gear refrigerating compressor differing from the types described above. While particular embodiments of the present invention have been illustrated and described, it would be apparent to those skilled in the art that various modifications and changes can be made without departing from the spirit of the present invention. It is therefore intended that the appended claims cover all such modifications and changes as may fall within the spirit and scope of the present invention.

What is claimed is:

1. A gear pump or motor comprising:

meshed nears including a shaft gear and a driven gear rotatable within a gear chamber defined by a housing and opposite side walls, the meshed gears delivering a fluid from an inlet chamber to an outlet chamber and having an interstice trapping the fluid;

a backlash of the shaft gear and the driven gear having fluid-leak-tight clearance;

a closed chamber provided in an internal portion of at least one of the opposite side walls;

an opening provided in one of the opposite side walls, a communication passage extending from the opening to the closed chamber; and at least one elastic disc capsule contained in the closed chamber, the at least one elastic disc capsule comprising a pair of concaved elastic disc plates abutting and sealed against each other with gas inside, of which occupying volume varies elastically subject to a fluid pressure therein enabling to absorb or expel the fluid trapped in the interstice during a trapping period of the interstice, whereby the fluid entrapped in the interstice isolated by the fluid-leak-tight clearance suppresses a pressure transmission inwardly or outwardly, wherein the volumetric variation during the trapping period is compensated by compression or expansion of the elastic disc capsule, suppressing pressure pulse and air bubble generation, and eliminating teeth bouncing contact.

2. The gear pump or motor of claim 1, wherein the opening is located at a position of being closed but ready to be opened to the trapped interstice by the side faces of the meshed gears at the very moment of starting to trap a decreasing interstice, enabling that the fluid leak from the trapped interstice to the closed chamber is prevented, and upon the rotation of gears, the communication passage is then opened during a period of decreasing interstice allowing for the trapped fluid to flow into the closed chamber and the elastic disc capsule to absorb a squeezed volume of the tapped fluid, and then during a period of increasing interstice, the absorbed volume of the fluid is repelled from the closed chamber to the increasing interstice, whereby the volumetric change of the trapped interstice is compensated without an undesirable fluid leak to the closed chamber.

3. The gear pump or motor of claim 1, wherein the number of the at least one elastic disc capsule is two or more, wherein the at least one elastic disc capsule independently insulates a vibration against each other, and whereby the elastic deflection of the each elastic disc capsule may share the volume variation of the trap interstice in a small portion enabling to respond to the extremely high frequency of the trap cycles of the interstices.

4. The gear pump or motor of claim 1, wherein an opening of the communication passage on the surface of one of the opposite side walls is provided symmetrically opposite on the opposite walls against each other at the cross centerline of the gear shaft centers, allowing that the trapping interstice formed at the side of the shaft gear and the driven gear may communicate with the closed chamber during rotation of the meshed gears.

5. A gear refrigerating compressor comprising:

meshed gears including a shaft gear and a driven gear rotatable within a gear chamber defined by a housing and opposite side walls, the meshed gears delivering a fluid from an inlet chamber to an outlet chamber and having interstices trapping the fluid;

a backlash provided between the shaft gear and the driven gear and including fluid-leak-tight clearance;

a pair of closed chambers provided in an internal portion of at least one of the opposite side walls;

an opening provided in at least one of the opposite side walls communicating with one of the interstices, a communication passage extending from the opening to one of the closed chambers; and at least one elastic disc capsule having a preset strength contained in one of the closed chambers, comprising a pair of concave elastic disc plates abutting and sealed against each other with a gas inside, of which occupying volume varies elastically subject to a fluid pressure therein enabling to absorb or expel the fluid in the interstices during a trapping period of the interstices, wherein the fluid trapped in the interstices and isolated by the fluid-leak-tight clearance suppresses a pressure transmission inwardly or outwardly of which the volumetric variation during the trapping period is compensated by compression or expansion of the elastic disc capsule, suppressing pressure pulses and air bubble generation and eliminating teeth bouncing contact.

* * * * *